United States Patent [19]

Crowley

[11] Patent Number: 4,744,519

[45] Date of Patent: May 17, 1988

[54] EXTENSION HOLDER DEVICE FOR PAINT SPRAYING APPARATUS

[76] Inventor: Brian W. Crowley, Box 3448, Midway, Wash. 98032

[21] Appl. No.: 34,928

[22] Filed: Apr. 6, 1987

[51] Int. Cl.[4] ..... B05B 15/06

[52] U.S. Cl. ..... 239/532

[58] Field of Search ..... 239/532, 280, 280.5, 239/281, 578; 222/174, 180; 251/294

[56] References Cited

U.S. PATENT DOCUMENTS

| | | | |
|---|---|---|---|
| 1,745,972 | 2/1930 | Beck | 239/532 |
| 1,849,511 | 3/1932 | Thompson | 239/532 |
| 3,915,382 | 10/1975 | Davis | 239/532 |
| 4,013,225 | 3/1977 | Davis | 239/532 |
| 4,023,711 | 5/1977 | Sena | 239/532 |
| 4,323,196 | 4/1982 | Logue et al. | 239/532 |
| 4,457,472 | 7/1984 | Geberth, Jr. | 239/532 |

FOREIGN PATENT DOCUMENTS

| | | | |
|---|---|---|---|
| 2230148 | 7/1978 | Fed. Rep. of Germany | 239/532 |

*Primary Examiner*—Andres Kashnikow
*Assistant Examiner*—Karen B. Merritt
*Attorney, Agent, or Firm*—George M. Cole

[57] ABSTRACT

Spray gun holding mechanism including a holding jaw body (20) having a U-shape with back wall (26), side walls (28,30), outwardly angling support walls on either side (40,42), and mounting means (46,48) by which the device is secured to a painter's roller extension pole on neck (50). A spring loaded trigger adjustment assembly (90) allows a gun secured into the device to be adjusted to the trigger and handle back dimension. A spring loaded trigger rod (62) engages the gun trigger and is actuated by a hand actuated cable (60) at the operator's end of the extension device. Means are provided for quick adjustment of angle of holder disposition, cable (60) slack and spray gun dimensions.

12 Claims, 3 Drawing Sheets

EXTENSION HOLDER DEVICE FOR PAINT SPRAYING APPARATUS

DESCRIPTION

1. Technical Field

The invention relates to the field of paint spray devices and more particularly to a holding mechanism for spray guns which attaches to the end of a painter's extension pole.

2. Background Art

Professional painters and those who have had some experience will generally acknowledge that access to areas which are above, below, or otherwise beyond the normal physical reach is a frustrating and time consuming problem. Ladders, scaffolding, staging and other platforms have been employed to reach such areas but these devices are awkward and cumbersome and involve the expenditure of a sizable amount of effort and time to utilize.

Since spray painting has become a widely accepted means of applying protective coatings, numerous extension devices for spray painting equipment have been developed to minimize the use of ladders, scaffolding, etc. Such extension equipment are essentially labor saving means since they eliminate to some degree the need to utilize other means to gain access to elevated areas.

Beyond the need for equipment to reach otherwise inaccessible areas without resorting to ladders or other platforms are problems associated with the equipment itself. A number of known extension devices are available in the market place but they are limited to the extent that they are compatible with the specific type of spray paint operating system for which they were designed. Their use is strictly limited to those particular painting operations where their specific operating system is appropriate. Accordingly, these known devices lack versatility or universality.

In the patented art of which applicant is aware, U.S. Pat. No. 4,013,225 describes an extension device designed to be used with a hydraulically atomized spray paint operating system, known as airless. The spray nozzle or tip is located at one end of a telescopically adjustable pole and the spray control valve is located at the opposite end of the pole. A spring biased valve is associated with the spray nozzle or tip orifice to prevent unatomized paint from exiting the tip orifice when ever the the spray control valve at the other end is closed. Closing the valve results in the momentary relaxation of the flexible hose between spray control valve and the tip orifice. This device contemplates a specific type of airless spray gun and operating system and thus is not adaptable to other commonly used spray paint systems.

U.S. Pat. No. 4,457,472 discloses an extendable spray gun for an airless spray painting system which, again, incorporates a specific structure with its own extension pole means. This device directs to an automatic reeling mechanism for the control cable which permits adjustment to the variations in length of the telescoping pole on which the spray head device is secured. This patented device confines itself to a specific structure and painting system and is not adaptable to different spray systems.

U.S. Pat. No. 4,323,196 shows a controllable angle spray nozzle or head which is manipulated by handle means near the operator's send of the pole. Like other prior art systems this device also confines itself to a specific structure and spraying system.

U.S. Pat. No. 3,915,382 is identical to U.S. Pat. No. 4,013,225 except that this one lacks the spring biased valve, the exclusioin of which allows unatomized paint to exit the tip orifice whenever the spray control valve is closed.

A common problem with the prior art extension devices for airless spray painting systems, but by no means the only problem, is their inability to satisfactorily perform when addressing the painting of elevated vertical surfaces within the operating length of the extensions. During the painting of an elevated horizontal surface there may be no problem in terms of the operator's ability to control the device so that a uniform coat of paint may be applied, a coat that meets both the visual and mil thickness requirements of the specifications under which the painting is to be performed. However, the painting of an elevated vertical surface of the same height, for example an adjoining wall or beam, may indeed prove impossible without the use of ladders or platforms due to the recoil effect or the "kicking" of the spray nozzle tip. The recoil effect results from the sudden release of highly pressurized paint, that is pressures ranging from two to five thousand psi, from the spray orifice located the elevated end of the extension device. Obviously, the recoil effect occurs at the beginning of each spray stroke or every time the control valve is triggered or opened.

It is to be kept in mind that a uniform paint coating is determined by (1) a fairly constant application spray rate, (2) a constant distance of the spray device from the surface being painted, and (3) a constant degree of overlap between strokes of the spray device, and thus it can be appreciated that operator control is of paramount importance. The recoil effect is most acute to airless extension devices since as the extension length increases the operator's ability to control the device decreases. Spray paint operating systems in which the operating pressures are substantially lower than airless systems and which allow better operator control at the higher elevations cannot be used with these patented extension devices. No airless extension devices for air-assisted airless paint spray systems is available in the market place and thus the advantages of employing such a paint spray system on elevated, out-of-reach surfaces cannot be realized without ladders or the like.

A number of spray paint operating systems have evolved to address the problems associated with using only one system over a wide range of application variables. The air-assisted airless, airless, siphon-feed air spray, and pressure feed air spray systems, the latter two often being referred to as conventional systems, are used thoughout the painting industry. The appropriateness of use of any system or combination of systems largely depends on the application variables of surface configuration and profile, surface area, wet or dry film thickness specifications of the coating, and the paint type or types in the case of multistep coating jobs.

The painting contractor frequently employs a combination of spray paint systems to meet certain project specifications and contractual requirements. An example of a situation requiring the use of two spray systems might exist in painting an elevated steel structure, the painting specifications for which call for a high solids inorganic zinc prime coat and then one or more finish coats. The applications variables above mentioned mandate the use of a pressure feed conventional spray unit with an agitating pressure pot. An airless unit is determined to be the most appropriate means for applying tie and finish coats. Here the known extension devices simply do not apply to both spray paint systems. The contractor must therefore employ ladders or the like during one phase of the the painting operation or utilize two extension devices.

Extension devices for conventional spray paint equipment are also available in the market place, but like those for airless equipment none are compatible with other types of paint spray systems. Additionally, the known extension devices for conventional spray systems are of a predetermined, fixed length. Where an elevated surface varies by more than the range the operator can comfortably manage and control with his extension, then the painting cannot continue without substituting an extension of different length or without resorting to a platform of some type. It is also to be kept in mind that the use of fixed length extensions, whether airless or conventional, is limited to those areas where the operator has sufficient room to maneuver his equipment. Confined areas render the use of such devices as impractical and awkward. Finally the spray head angle relative to the surface cannot be readily adjusted. Accordingly, the painting of some structures, an I-beam for example, cannot be accomplished with conventional extension devices without resorting to ladders or platforms or without substituting one extension for another which has a different spray head angle. It should be noted that a certain amount of time is required to substitute extension devices. Depending on the drying time of the paint material being applied, a brief interruption of the spraying may well cause a wet edge loss. Often this condition results in lap marks, a visually unacceptable finish particularly in the commercial area where a visually uniform surface coating is as important as the integrity of the surface coating itself.

DISCLOSURE OF THE INVENTION

The invention consists of a spray gun holding mechanism which can be detachably secured to the end of a painter's roller extension pole. The device comprises a holding jaw body into which the handle of a wide variety of spray guns may be releasably secured. Latching means secure the spray gun in the holder jaw and a cable having a spring loaded mechanism therein engages the trigger of the spray gun to actuate the same from the operator's handle at the other end. The cable extends from the operator's handle to the holder and the spring loaded mechanism. Rapid adjustment of the cable length is made by hand operated means at the actuating handle so that the cable can be set to the length of the pole and to the angle at which the holder device and the gun are set.

Accordingly, it is among the features and advantages to provide a holding device for spray guns that is simple, rugged and extremely inexpensive in comparison to others. The holder device of this invention will accept and hold virtually all hand operated spray guns whether they are airless, air-assisted airless, air spray pressure feed, or siphon fed air spray types and whether the gun handle is oblong or round. The holding device is universal in its acceptance of various types of spray guns. It adapts to and can be mounted on any painter's common extension pole whether of fixed length or adjustable. The device has few moving parts, is quick adjusting both in attaching the gun and setting its angle and for correcting the length of the control cable. The device saves the painter both time and effort and permits him to use his existing spray system without the necessity for acquiring additional equipment.

BEST MODE FOR CARRYING OUT THE INVENTION

Figure 1:
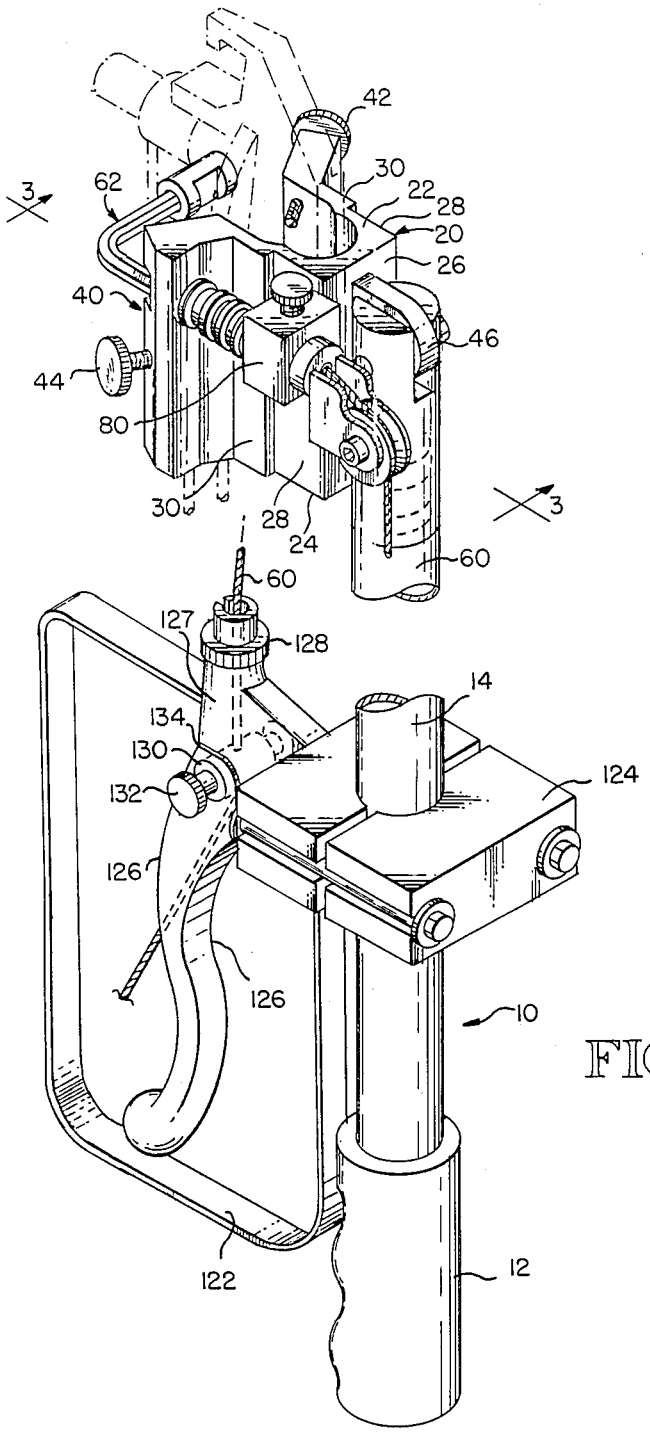
FIG. 1 is a view in perspective showing the holder device mounted and its operating handle attached on a painter's roller extension pole.

Spray painting has become widely accepted as a means of applying protective coatings and a number of different spray systems have evolved to address the problems associated with using one system over the wide range of applications. The more common systems in use by commercial and industrial contractors are (1) the hydraulically atomized or airless system;, (2) the air supplied airless system; (3) the siphon feed air spray or conventional system; and (4) the pressure feed conventional system. The contractor may employ any combination of these systems during a project depending on surface area, surface configuration, mil thickness requirements, surface finish requirements, paint material type, and surface substrate. As mentioned above painting elevated surfaces or surfaces above, below or beyond normal reach is a time consuming problem. Ladders, staging, scaffolding, and other platforms have generally been used when painting such surfaces. A considerable amount of time can be devoted to setting up and dismantling. Thus, the need for extensions to reduce the time factor.

Referring now to the drawings it will be seen that a conventional fixed length or telescoping painter's roller pole generally designated by the number 10 has an operator's hand control end 12, main pole shank or body 14, and standard threaded end 16 for holding a painting device such as a roller. Poles are available in various lengths.

At the end 16 of pole 10 is received a spray gun holding jaw or body generally designated by the number 20. As is seen in the drawings body 20 is substantially U-shaped and of predetermined length from upper end 22 to lower end 24. The body includes a back wall 26, first side walls 28, and second side walls 30 which are stepped outwardly by offset surfaces 32 on each side of the body. Inside body 20 between walls 28 is a first curved surface 34 to accommodate an oblong spray gun handle. Between outside walls 30 are second curved surfaces 36 to accommodate a round gun handle.

Figure 4:
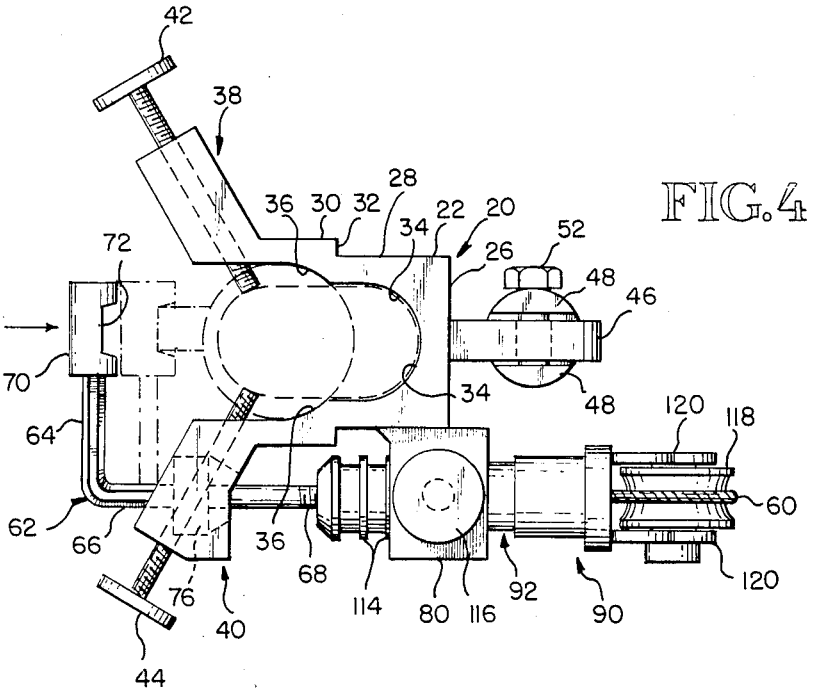
FIG. 4 is a plan view of the holder from above showing additional details of its construction.

At the outer ends of walls 30 are outwardly angling auxiliary support walls 38 and 40. It will be seen that support walls 38 and 40 are generally thicker than wall sections 28 and 30 for reasons which will become apparent. Support wall 38 on one side of the body receives a pair of threaded locking screws or bolts 42 and wall 40 on the other side receives a single locking bolt member 44. The three locking bolts firmly secure a spray gun in place within the body cavity when they are threaded snugly against the gun housing as is seen in FIG. 4. On the back wall 26 on the outside is an outwardly extending bracket 46 which is received between yokes 48 on the threaded mounting neck 50 which attaches to the pole. A bolt 52 is threaded into holes in the yoke members 48 and allows quick adjustment of the angle at which the holder body and the spray gun are set.

A control cable 60 extends from a control handle along the length of the pole to the holder body in a manner now to be described.

An L-shaped trigger actuating rod member 62 has a first leg 64 which extends across the trigger of the spray gun and a second leg 66 which extends into a spring loaded cable return or retraction assembly. The actuating rod 62 has a hexagonal cross section like an allen wrench but is threaded as at 68 on the end of second leg 66. First or trigger leg 64 receives a round trigger grip member 70 with slot 72 which engages the trigger of the gun.

Figure 3:
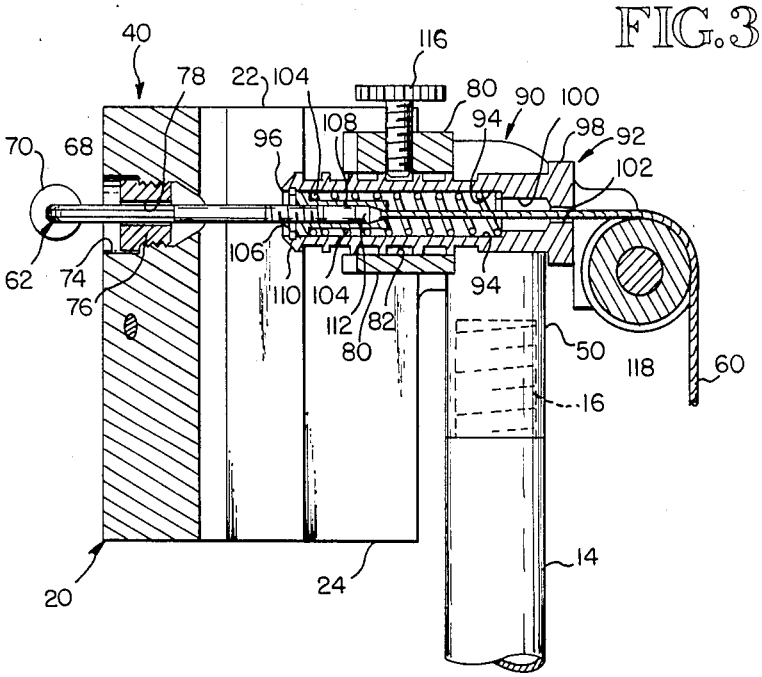
FIG. 3 is a partial cross section view in elevation showing details of construction of the cable spring loaded retraction means.

An opening 74 through auxiliary wall 40 as best seen in FIGS. 3 and 4 receives a threaded restraining member 76 which has a hexagonal opening 78 in which the second leg 66 of the actuating rod slides but which will not permit the rod to rotate and slip off the trigger.

The threaded end 68 of the actuating rod is attached to a resilient cable return assembly mounted in an opening 82 in a mounting block 80 attached to or formed integrally with body 20 such that opening 82 is axially aligned with leg 66 and opening 74. The resilient assembly, generally designated by the number 90, includes an adjustment barrel 92 which is an elongated cylindrical member having interior surface or bore 94 extending from an open end 96 to close proximity to a head end 98. It will be noted that head end 98 includes a secondary or smaller bore cavity 100 and cable pass through opening 102. The smaller bore is defined by an annular offset surface against which one end of a coiled compression spring 104 abuts. Spring 104 extends the length of bore 94 to an axially movable cylindrical sleeve member 108 which has a head section 110 which abuts against and is held by C clip 106 just inside end 96 of the barrel. The inside surface of the head 110 engages one end of spring 104. The other end of sleeve 108 is generally closed except for the cable opening therein. Inside sleeve 108 is a cable ferrule or nipple 112 which is permanently secured to the end of cable 60. The head end 110 of sleeve 108 is threaded on the interior to receive threads 68 of leg 66 of the actuating rod. When cable 60 is pulled at the operator's end the sleeve and thus rod 62 are moved against the compression spring pressure and the gun trigger is depressed. When the operating handle is released the spring loaded assembly retracts the cable and rod 62 is released from the depressed trigger and the gun shuts off. A series of spaced apart ridges 114 are located on the exterior of barrel 92. The mounting block 80 includes a lock bolt 116 which engages the barrel 92 between ridges 114 to firmly hold the barrel against inadvertent movement.

Cable 60 extends out through opening 102 and over pulley 118 which is mounted on assembly 90 between support brackets 120 attached to head end 98 of the barrel.

At the operator's end of pole 10 is a handle guard 122 secured to a mounting block 124 which in turn is detachably secured to pole 10. A control lever 126 is pivotally mounted with respect to a fixed section 127 of the control handle. Cable 60 extends to and through a guide screw 128, and then through a bushing 130 with a cable lock screw 132 which are in the heel of the handle 126. When handle 126 is depressed the heel separates along line 134 from fixed portion 127 and cable 60 is moved. When the cable is pulled by action of handle 126 the actuating rod 62 is also moved to depress the gun trigger to actuate the spray gun.

Figure 2:
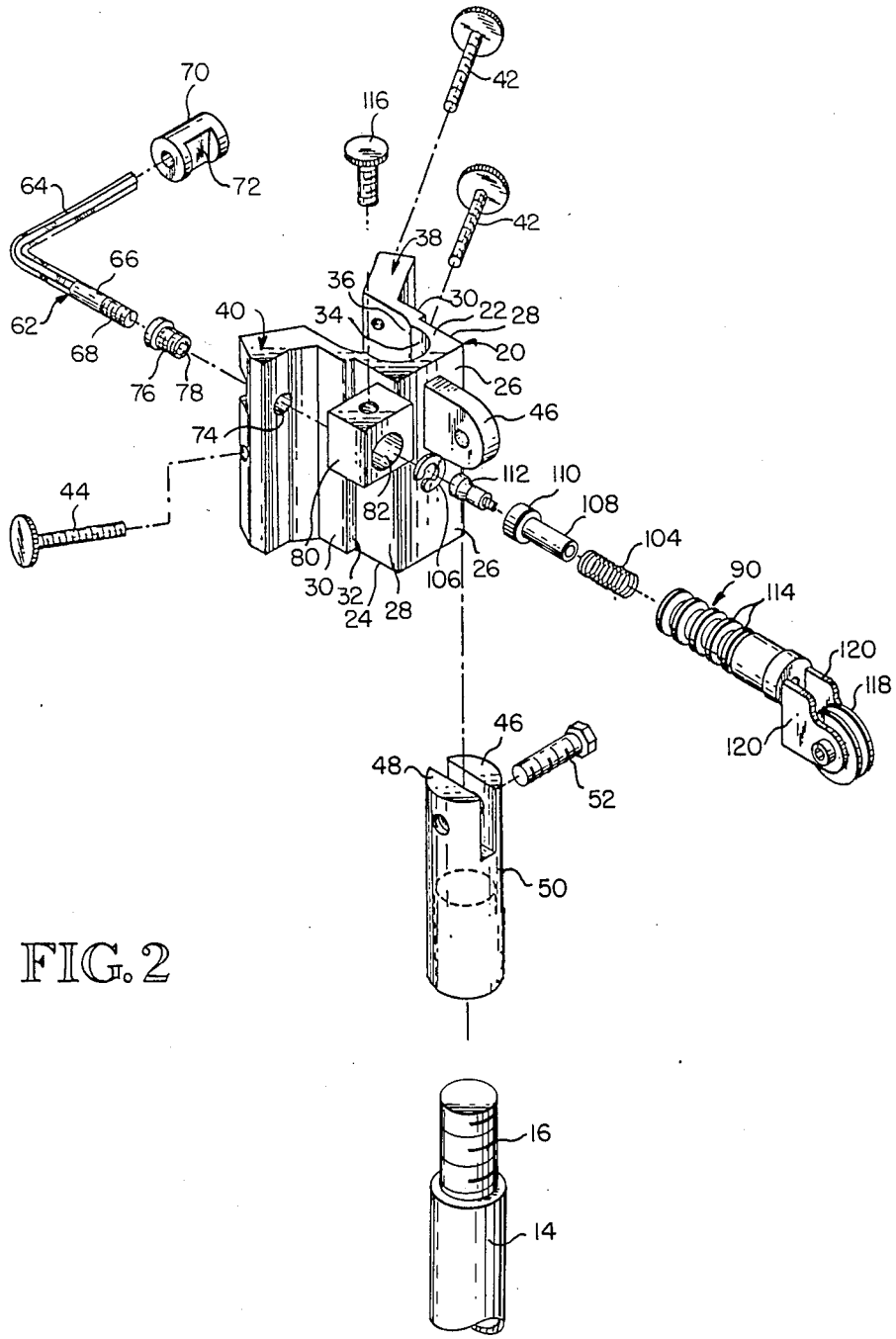
FIG. 2 is an exploded view in perspective showing additional details of construction of the device of FIG. 1.

It will be appreciated that when a gun is removed or attached the lock bolt 116 for the spring loaded assembly is released from the barrel to allow the barrel to slide axially. This permits the hex part of leg 66 to disengage restraining nut 76 so that the rod can be rotated out of the way. When a gun is secured in place the rod is rotated into position, the barrel is moved until rod and trigger grip 70 are against the trigger. The barrel is then locked in position by lock bolt 116 and any slack in cable 60 is adjusted by releasing bushing lock bolt 132 and then relocking it down on the cable. In this way the system is ready for work since the adjustments can be made quickly and with a minimum of inconvenience to the painter. It will be appreciated that adjustments in the cable can and will be made upon changes of length in the pole or perhaps changes in the angle at which holder and gun are set by lock bolt 52 on the back of body 20. It is to be noted with respect to FIG. 2 that the movement of barrel 92 enables the invention to be adapted to various dimensions between the back of the gun handle and trigger face. Also the device adjusts to the amount of trigger movement for a specific gun. New equipment provides a predetermined distance between the back of a handle and the trigger face but trigger wear reduces the distance until the parts have to be replaced.

It is to be understood that the ridges 114 on barrel 92 may be incorporated but are not critical. Because of the substantial wall thickness of barrel 92 the lock screw or bolt can be tightly snugged down to prevent any incidental longitudinal movement of the barrel. It will also be appreciated that cavity 100 is not a critical feature and may be eliminated so that sleeve 108 can be shortened although its function will not otherwise be changed.

It is contemplated that block 80 may extend to support wall 40 if desired to form a continuous cavity support for the spring loaded assembly. The angular adjustment capability of body 20 on neck 50 can be accomplished in a manner different from the yoke and bracket shown. For instance, spring loaded detents could be used to click the holder body to the desired angle. In this way positive setting of the desired angle is achieved. Finally it will be understood that the operation of the trigger rod 62 may be accomplished by incorporation of a hydraulic actuator in place of the manual actuation shown. Finally, the body may be made of plastic and injection molded and furthermore the offset walls 28 and 30 may be eliminated if desired.

I claim:

1. Spray gun holder and actuator mechanism for a painter's extension pole, comprising:

(a) a spray body member adapted to be secured to one end of said painter's pole and which is generally U-shaped and of a predetermined length to define a cavity area through its length to receive the handle portion of a spray gun, said body member having releasable holding means for securing said handle of said spray gun therein, said body member having an outside back section with pivotal means which is adapted to be removably attached to an extension pole, (b) a spray gun trigger valve actuating means adapted to engage the trigger valve of a spray gun held in said cavity area, said actuating means including cable means operably attached to said actuating means, said cable means extending from said holder device along the length of said extension pole to a hand control means at the other end of said pole for exerting pull pressure on said cable means to cause movement of said actuating means and thereby to actuate said spray gun trigger valve, (c) resilient return means mounted on said body member and operably connected to said cable means and to said actuator means such that positive release of said trigger valve from its actuated position to unactuated position is effected, said resilient return means also including quick adjustment means for adapting said actuating means and said cable means to changes in pole length and differences in spray gun configurations.

2. The spray gun holder and actuator mechanism according to claim 1 and wherein said trigger valve actuating means is a generally L-shaped rod such that one leg of said rod engages said trigger valve and the second leg of said rod is operably connected to said resilient means such that the actuating means is movable to depress said trigger valve and also rotatable so as to allow a spray gun to be quickly installed or removed from said holder body.

3. The spray gun holder and actuator mechanism according to claim 1 and wherein said resilient means is an adjustable spring loaded assembly operably interconnecting one end of said cable means and the second leg of said rod actuating means.

4. The spray gun holder and actuator device according to claim 1 and wherein pulley means for said cable means are connected to said resilient means.

5. The spray gun holder and actuator device according to claim 1 and wherein said hand control means comprises a hand lever member which pivots through a limited arc to exert pull on said cable means, said hand lever member including rapid adjustment means for operably adjusting said cable means to a spray gun and to pole length.

6. The spray gun holder and actuator device according to claim 1 and wherein the second leg of said actuating rod extends through and is engaged by a restraining means for preventing said actuating rod from rotating when all adjustments have been made.

7. The spray gun holder and actuator according to claim 3 and wherein said adjustable spring loaded assembly resiliently tensions said cable means and said second leg of said actuating rod such that said actuating means is snugly engaged with the trigger valve of said spray gun.

8. The spray gun holder and actuator device according to claim 2 and wherein said resilient means is an adjustable spring loaded assembly operably interconnecting one end of said cable means and the second leg of said actuating rod.

9. The spray gun holder and actuator device according to claim 8 and wherein pulley means for said cable means are connected to said resilient means.

10. The spray gun holder and actuator device according to claim 9 and wherein said hand control means comprises a hand lever member which pivots through a limited arc to exert pull on said cable means, said hand lever member including rapid adjustment means for operably adjusting said cable means to a spray gun and to pole length.

11. The spray gun holder and actuator device according to claim 10 and wherein the second leg of said actuating rod extends through and is engaged by a restraining means for preventing said actuating rod from rotating when all adjustment have been made.

12. The spray gun holder and actuator according to claim 11 and wherein said adjustable spring loaded assembly resiliently tensions said cable means and said second leg of said actuating rod such that the first leg of said actuating rod is snugly engaged with the trigger valve of said spray gun.

* * * * *